United States Patent [19]

McMorries, IV

[11] Patent Number: 4,954,109

[45] Date of Patent: Sep. 4, 1990

[54] WATER PICKUP INSERT

[75] Inventor: Lee W. McMorries, IV, Stillwater, Okla.

[73] Assignee: Brunswick Corporation, Fond du Lac, Wis.

[21] Appl. No.: 382,297

[22] Filed: Jul. 20, 1989

[51] Int. Cl.[5] ..... B63H 21/38

[52] U.S. Cl. ..... 440/78; 440/76; 440/88

[58] Field of Search ..... 440/76, 78, 88, 89

[56] References Cited

U.S. PATENT DOCUMENTS

| | | | |
|---|---|---|---|
| 4,752,257 | 6/1988 | Karls et al. | 440/88 |
| 4,767,366 | 8/1988 | Lang | 440/76 |
| 4,832,640 | 5/1989 | Karls | 440/88 |

OTHER PUBLICATIONS

Exhibit A–Photograph of a Hose Clamp.
Exhibit B–Photograph of a Hose Clamp.
Exhibit C–Photograph of a Hose Clamp.

*Primary Examiner*—Sherman Basinger
*Assistant Examiner*—Thomas J. Brahan
*Attorney, Agent, or Firm*—Laney, Dougherty, Hessin & Beavers

[57] ABSTRACT

A cooling water pickup system is provided for a marine stern drive. The stern drive includes an outdrive housing having a cooling water passage defined therein with first and second cooling water inlet openings defined on opposite sides of the housing and communicated with the passage. An exterior surface of the housing has first and second recesses defined therein by first and second recessed shoulders adjacent the first and second cooling water inlets. First and second inserts are received within the first and second recesses and abut the respective recessed shoulders. Each insert includes a locking member extending inward into the cooling water passage. The locking members of the first and second inserts each include a camming surface and an outwardly facing locking surface located outward of the camming surface. When the first and second inserts are placed in the recesses of the housing and moved toward each other, the first and second camming surfaces engage each other creating transversely directed camming forces. At least one of the locking members is sufficiently resilient to be deflected to allow the locking members to overlap until the first locking surface moves past the second locking surface to lock the inserts in place within the housing.

15 Claims, 4 Drawing Sheets

WATER PICKUP INSERT

BACKGROUND OF THE INVENTION

1. Field Of The Invention

The present invention relates generally to cooling water systems for marine engines, and more particularly, to cooling water pickup inserts designed for assembly with a marine outdrive housing.

2. Description Of The Prior Art

Two of the more popular drive systems presently in use for boats and other offshore vessels are stern drive and outboard power systems. Stern drives, also sometimes referred to as inboard/outboard systems, utilize an engine mounted inside the boat, with an outdrive unit extending through the transom of the boat and downward into the water. Outboard systems have the entire engine mounted on the transom of the boat with the lower unit of the engine extending down into the water.

Both stern drive and outboard systems have cooling water inlet passages defined in the housing portion of the system which extends downward into the water. The inlets to the cooling water passage may either be cast in the housing, or may be defined with inserts which are separable from but attached to the housing.

The present invention is directed to an improved insert assembly particularly suitable for use with MerCruiser® Alpha Series stern drives manufactured by Mercury Marine of Fond du Lac, Wisc.

The MerCruiser® Alpha Series stern drives presently utilize separate cooling water pickup inserts which are bolted in place on the outdrive housing. Although this system is certainly very satisfactory in performance, the assembly of the system is labor-intensive. The prior art insert assembly is comprised of four separate parts, namely the two inserts and a bolt and a nut, which must be manually assembled.

SUMMARY OF THE INVENTION

The present invention is directed to an improvement in such cooling water inserts which simplifies the assembly of the inserts with an outdrive housing, and which reduces the overall cost of the assembly.

Particularly, the cooling water pickup system of the present invention provides first and second inserts designed for assembly with a marine outdrive housing. The outdrive housing has a cooling water passage defined therein with first and second cooling water inlet openings defined through opposite sides of the housing and communicating the passage with an exterior surface of the housing. The exterior surface of the housing has first and second recesses defined therein by first and second recessed shoulders adjacent the first and second cooling water inlet openings, respectively.

The first insert is received in the first recess of the housing and abuts the first recessed shoulder. The first insert includes a first locking member extending inward into the cooling water passage, which first locking member includes a first camming surface and an outwardly facing first locking surface located outward of the first camming surface. Similarly, the second insert is received in the second recess of the housing and abuts the second recessed shoulder. The second insert includes a second locking member extending inward into the cooling water passage, which second locking member includes a second camming surface and an outwardly facing second locking surface located outward of the second camming surface.

When the first and second inserts are inserted into the first and second recesses of the housing and urged toward each other, the first and second camming surfaces engage each other creating transversely directed camming forces. At least one of the locking members is sufficiently resilient to be deflected to allow the locking members to overlap until the first locking surface moves past the second locking surface to lock the inserts in place as the resilient locking member returns toward an undeflected position.

In one embodiment of the invention, at least one of the locking members includes a plurality of sequentially located camming surfaces and a plurality of outwardly facing locking surfaces alternately located between the camming surfaces. This permits a discretely incrementally adjustable overlapping locking engagement between the first and second locking members to accommodate manufacturing tolerances in both the inserts and the outdrive housing. This allows the inserts to be snugly positioned within the recesses of the housing.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
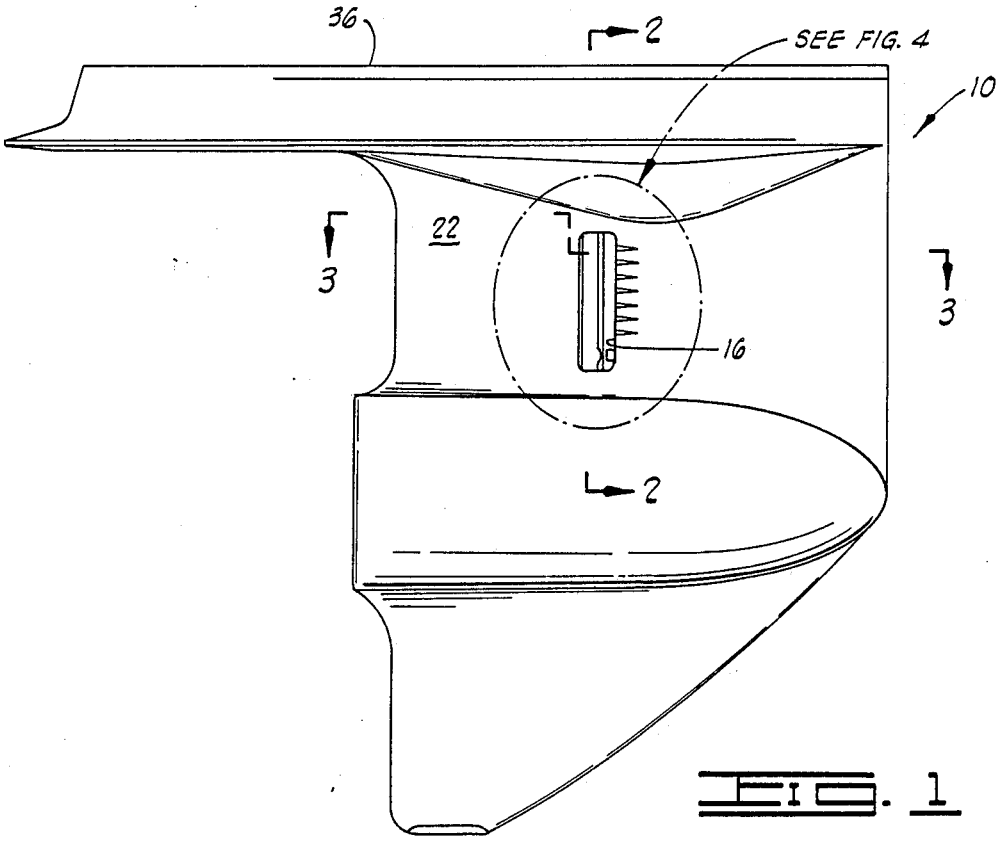
FIG. 1 is a starboard side, or right side, elevation view of a gear case, which may also be referred to as an outdrive housing, of a marine stern drive system.

Referring now to the drawings, and particularly to FIG. 1, a right side or starboard side elevation view is thereshown of a gear case of a MerCruiser® Alpha Series stern drive system. FIG. 1 shows only the gear case, and does not show other components of the stern drive system which normally are attached to the gear case. The gear case of FIG. 1 may be generally referred to as an outdrive housing, and is designated by the numeral 10.

Although the present invention will be described herein in the context of a stern drive system, it will be understood that it could also be utilized in the cooling water system of an outboard engine, and that the lower end portions of the outboard system could also be generally referred to an outdrive housing.

Figure 2:
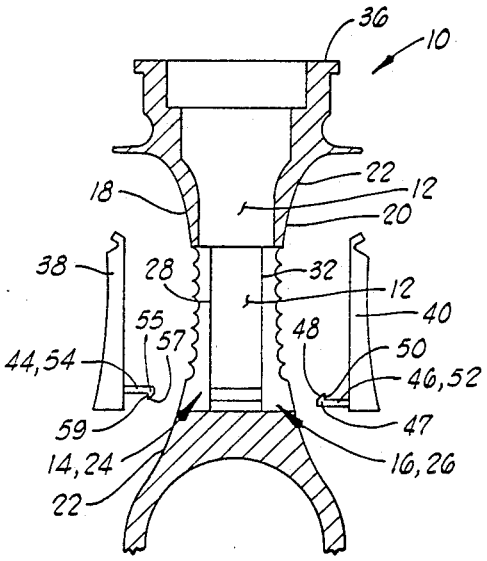
FIG. 2 is a sectioned partial elevation view of the outdrive housing taken along line 2—2 of FIG. 1. The cooling water pickup insert assembly of the present invention is shown in exploded view in relation to the outdrive housing.
Figure 3:
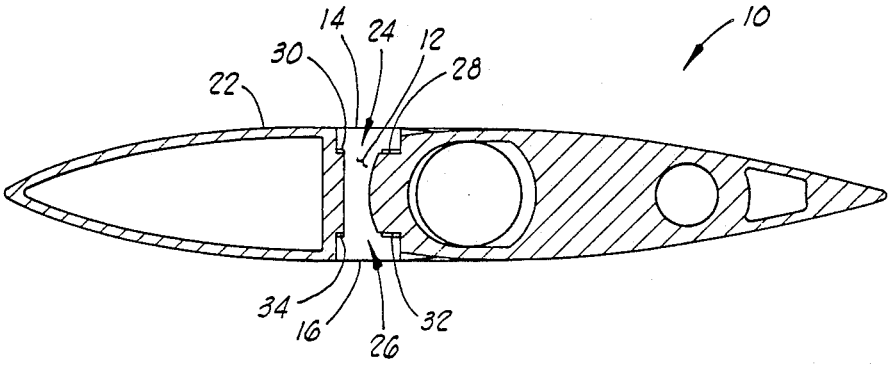
FIG. 3 is a horizontal section view taken along irregular line 3—3 of FIG. 1, showing the cooling water inlets and recesses in cross section.

Portions of the internal structure of the outdrive housing 10 are seen in the cross-sectional views of FIGS. 2 and 3. The outdrive housing 10 has a cooling water passage defined therein which is generally designated by the numeral 12. The cooling water passage 12 includes left and right cooling water inlet openings 14 and 16 defined through left and right sides 18 and 20 of the housing 10 and communicating the passage 12 with an exterior surface 22 of the housing 10. As seen in FIG. 3, prior to the assembly of the inserts with the outdrive housing 10, the cooling water passage 12 is directly open between the left and right inlets 14 and 16.

The exterior surface 22 of housing 10 has left and right recesses defined therein as generally designated by the numerals 24 and 26.

The inwardmost extent of the left-hand recess 24 is defined by forward and rearward recessed shoulders 28 and 30, respectively, located adjacent the left-hand cooling water inlet opening 14. The inwardmost extent of right-hand recess 26 is defined by forward and rearward recessed shoulders 32 and 34, respectively, located adjacent the right-hand cooling water inlet opening 16.

As best seen in FIG. 2, the cooling water passage 12 extends upward to a top 36 of outdrive housing 10. It will continue through other components (not shown) of the marine outdrive system to ultimately communicate the cooling water inlets 14 and 16 with the cooling water jacket of the engine which is to be cooled.

In FIG. 2, left-hand and right-hand cooling water pickup inserts are shown in exploded view and generally designated by the numerals 38 and 40, respectively.

Figure 4:
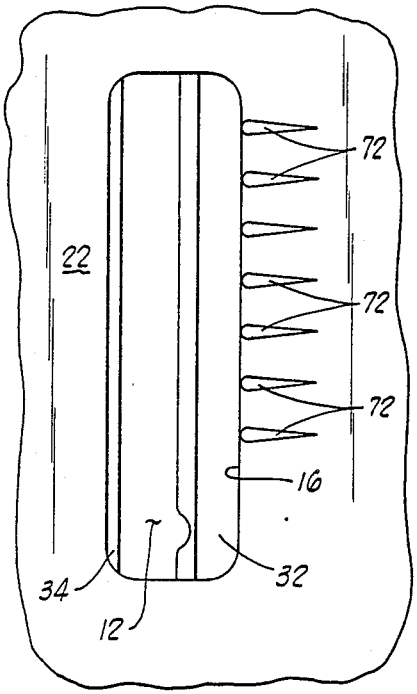
FIG. 4 is an enlarged right side elevation view of the right side cooling water inlet opening of the outdrive housing of FIG. 1.
Figure 5:
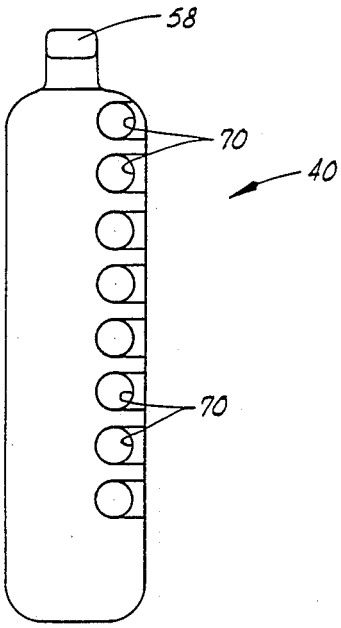
FIG. 5 is a right side elevation view of the right-hand or starboard side cooling water pickup insert.
Figure 6:
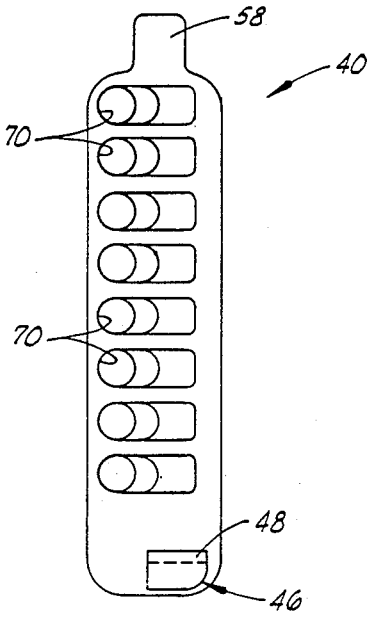
FIG. 6 is a left side elevation view of the right-hand cooling water pickup insert of FIG. 5.

In FIG. 4, an enlarged right-side elevation view is shown of the portion of outdrive housing 10 surrounding right-hand cooling water inlet 16. The details of construction of the right-hand insert 40, which is received in recess 26 adjacent inlet 16, are best seen in the enlarged views of FIGS. 5–7. The insert 40 includes a plurality of openings 70 defined therethrough in a manner so that water is directed from the lake or ocean surrounding the housing 10 through the openings 70 into the cooling water passage 12. The housing 10 has a plurality of small vanes 72 located between adjacent openings 70 to aid in guiding the water into the openings 70.

Figure 2A:
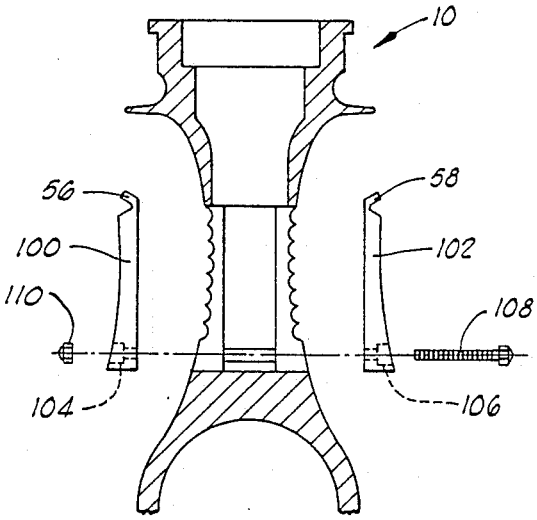
FIG. 2A (PRIOR ART)
FIG. 2A is a view similar to FIG. 2 showing a prior art cooling water pickup insert assembly in exploded view in relation to the outdrive housing.
Figure 2B:
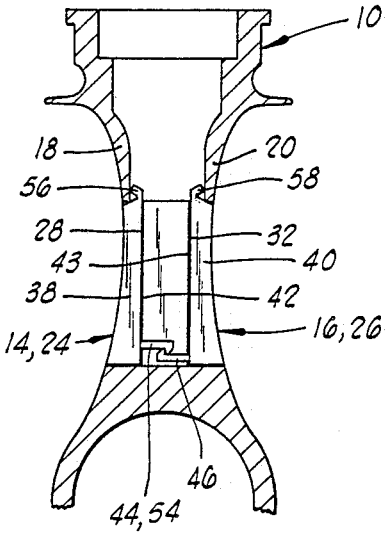
FIG. 2B is a view similar to FIG. 2 showing the cooling water pickup insert assembly of FIG. 2 assembled together with the outdrive housing.

FIG. 2B illustrates the manner in which the left and right-hand inserts 38 and 40 are inserted into the left and right-hand recesses 24 and 26, respectively, and assembled together with the outdrive housing 10.

The left-hand insert 38 is received within the first recess 26 with an inward facing side 42 of insert 38 abutting the recessed shoulders 28 and 30. Similarly, an inward-facing side 43 of right-hand insert 40 abuts recessed shoulders 32 and 34 when the right-hand insert 40 is received in the right-hand recess 26.

The left-hand insert 38 includes a first locking member 44 which extends inward into the cooling water passage 12. The right-hand insert 40 includes a complimentary second locking member 46 which also extends inward into the cooling water passage 12.

Figure 7:
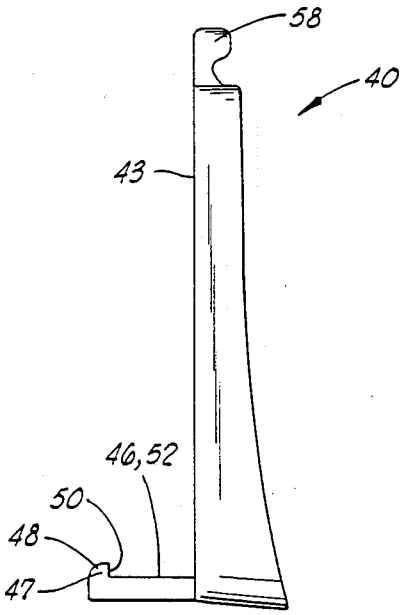
FIG. 7 is a rear elevation view of the right-hand cooling water pickup insert of FIG. 5.

As best seen in FIG. 7, the second locking member 46 includes an upward extending protrusion 47 having a camming surface 48 and an outwardly facing locking surface 50 located outward of the camming surface 48.

The locking member 46 of right-hand insert 40 includes a resilient cantilevered arm portion 52. The right-hand insert 40 including the second locking member 46 is preferably integrally constructed by molding the same from a polymeric plastic material. A typical polymeric plastic material for the inserts 38 and 40 is a 33% glass reinforced nylon.

The first locking member 44 of left-hand insert 38 is constructed in a similar fashion, but as seen in FIG. 2B, it is oriented in a manner complimentary to the second locking member 46. Its cantilevered arm portion 54 is located at a slightly higher elevation than the cantilevered arm portion 52 of second locking member 46. First locking member 44 also includes a camming surface 57 (see FIG. 2) and an outwardly facing locking surface 59 which are defined on a downwardly extending protrusion 55 of the locking member.

With reference to each of the inserts 38 and 40, the terms inward and outward are defined in general relation to the outdrive housing 10. Thus, the locking surface 50 of insert 40 is referred to as an outwardly facing locking surface because it faces in the same general direction as the portion of the outer surface 22 of housing 10 in which the insert 40 is mounted, i.e., to the right in FIG. 2. Correspondingly, for the left-hand insert 38, the "outwardly" facing locking surface 59 faces in the opposite direction, i.e., to the left in FIG. 2, of the outwardly facing locking surface 50 of right-hand insert 40.

When the left and right-hand inserts 38 and 40 are inserted into the left and right-hand recesses 24 and 26 of the housing 10, and are then urged toward each other, the camming surfaces 57 and 48 of the first and second locking members 44 and 46 engage each other creating transversely, in this case vertically, directed camming forces. The cantilevered arm portions 54 and 52 of the first and second locking members 44 and 46 are sufficiently flexible and resilient to be deflected to allow the locking members to overlap as shown in FIG. 2B until the locking surfaces 59 and 50 move past each other and the resilient cantilevered arm portions then flex back toward each other so that the overlapping protrusions are interlocked to lock the inserts 38 and 40 in place on the housing 10.

The left and right-hand inserts 38 and 40 each include retaining tabs 56 and 58, respectively, extending upward from the upper ends thereof. As seen in FIG. 2B, the retaining tabs 56 and 58 are received behind the left and right side walls 18 and 20, respectively, of the housing 10 to hold the upper ends of the inserts 38 and 40 in place within the left and right-hand recesses 24 and 26. The first and second locking members 44 and 46 are located generally adjacent the lower ends of the left and right-hand inserts 38 and 40, respectively.

The tabs 56 and 58 can be more generally referred to as first and second outdrive engagement means 56 and 58 defined on the upper ends of the inserts 38 and 40 for holding the upper ends of the inserts in place on the outdrive housing 10.

Thus, in order to assemble the inserts 38 and 40 as seen in FIG. 2B, the upper ends of the inserts are first inserted into the recesses 24 and 26 to locate the upwardly extending tabs 56 and 58 behind the walls 18 and 20, respectively. Then the lower ends of the inserts 38 and 40 are pushed toward each other until the locking members 44 and 46 lock together.

The interlocking relationship between the first and second locking members 44 and 46 can also be generally described as having a protrusion such as 47 of one of the locking members resiliently snapping into place in a complimentary cavity, such as the space outward of the locking surface 59 of the locking member 44, so as to lock the members together.

The first and second locking members 44 and 46 may be collectively defined as a locking means 44, 46 defined on the first and second inserts 38 and 40 for locking the first and second inserts 38 and 40 together to hold the inserts in place on the outdrive housing 10 when the inserts 38 and 40 are pushed toward each other with the outdrive housing 10 sandwiched therebetween. The locking members 44 and 46 may also be generally described as locking elements 44 and 46 attached to the first and second inserts 38 and 40, respectively, said locking elements 44 and 46 being slidably lockingly engaged with each other when the first and second inserts 38 and 40 are pushed toward each other into their assembled position of FIG. 2B.

In the embodiment shown in FIG. 2B, the first and second locking members 44 and 46 are substantially equally resilient in response to the vertical camming forces generated by the engaged protrusions 47 and 55 of the locking members. It will be appreciated, however, that it is really only necessary that one of the locking members be constructed in a resilient fashion.

In the embodiment of FIG. 2B, each of the locking members 44 and 46 includes one and only one camming surface such as the camming surface 48, and one and only one locking surface such as the locking surface 50.

Figure 8:
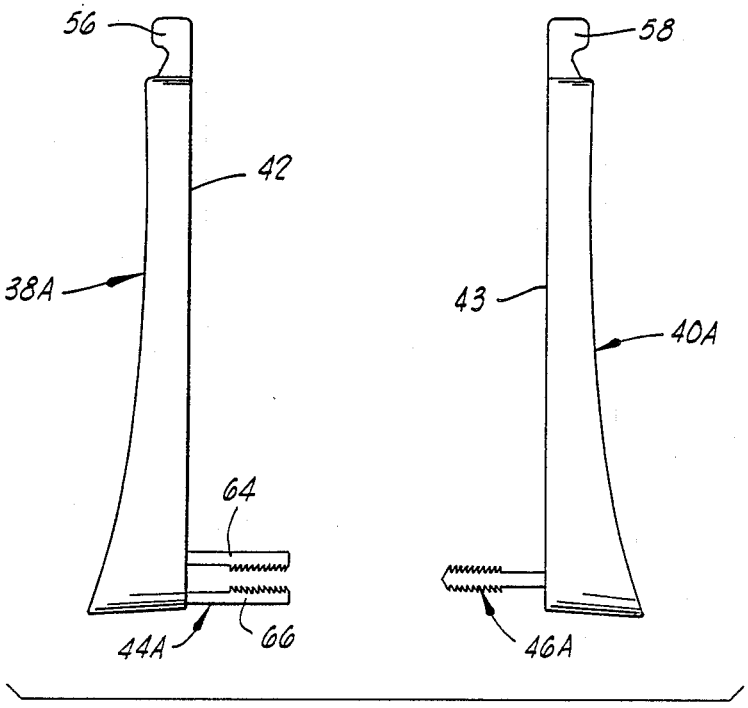
FIG. 8 is a rear elevation view of a pair of cooling water pickup inserts which have been modified in accordance with another embodiment of the present invention.
Figure 9:
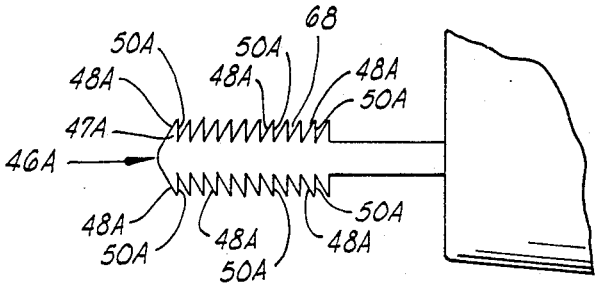
FIG. 9 is an enlarged view of the locking member attached to the lower end of the right-hand insert in the embodiment of FIG. 8.

FIGS. 8 and 9, on the other hand, show an alternative embodiment of the inserts 38 and 40, which are designated by 38A and 40A. It will be understood that the inserts 38A and 40A fit together within the same housing 10 as previously described in a manner generally similar to that just described for inserts 38 and 40.

In the embodiment of FIGS. 8 and 9, the first and second locking members have been modified and are generally designated as 44A and 46A, respectively. Each of the locking members 44A and 46A includes a plurality of sequentially located camming surfaces and a plurality of outwardly facing locking surfaces alternately located between the camming surfaces.

In the embodiment of FIG. 8, the first locking member 48A includes upper and lower spaced portions 64 and 66, respectively. The upper portion 64 has camming surfaces and locking surfaces defined on the bottom thereof so as to form a generally serrated appearance. Similarly, the lower portion 66 has its locking surfaces and camming surfaces defined on the top surface thereof which faces the bottom surface of upper portion 64.

The locking member 46A is constructed to be received between the upper and lower portions 64 and 66 of locking member 44A. As best seen in the enlarged view of FIG. 9, the locking member 46A has alternating camming surfaces 48A and locking surfaces 50A defined on both the top and bottom thereof for engagement with the upper and lower portions 64 and 66 of locking member 44A.

When the locking member 46A is inserted between the upper and lower portions 64 and 66 of locking member 44A, one or both of the upper and lower portions 64 and 66 will flex away from each other so as to allow the locking member 46A to be received therebetween.

This construction wherein each of the locking members 44A and 46A includes a plurality of alternating camming surfaces and locking surfaces which are constructed to mesh together, permits a discretely incrementally adjustable overlapping locking engagement between the first and second locking members 44A and 46A. This allows manufacturing tolerances for the inserts and for the outdrive housing 10 to be accommodated so that the inserts 38A and 40A can be snugly held in place within the housing 10 by locking members 44A and 46A.

Each alternating pair of camming surfaces 48A and locking surfaces 50A can be generally described as forming a tooth or protrusion 47A, with adjacent teeth 47A being separated by cavities or spaces 68. When the locking members 44A and 46A are locked together, they can be generally described as having the teeth of one of the locking members received in the complimentary cavities of the other locking member.

This provides a means for varying the spacing between the lower ends of the first and second inserts 38A and 40A in discrete increments defined by the spacing between adjacent locking surfaces 50A. This allows the inserts 38A and 40A to be locked snugly in place by pushing the first and second locking members 44A and 46A together as far as possible so that the inwardmost tooth or protrusion of each locking member snaps into place into an outwardly furthest possible one of the complimentary cavities or gaps between the teeth of the other locking member.

FIG. 2A is a view similar to FIG. 2 which illustrates an exploded view of the prior art cooling water insert pickup assembly presently being utilized by the assignee of the present invention with outdrive housings like the housing 10. The housing 10 itself is a part of the prior art. The insert assembly which has typically been used in the past with the housing 10 includes left and right-hand inserts 100 and 102. The inserts have openings 104 and 106, respectively, as shown in dashed lines disposed through their lower ends. A bolt 108 extends through the openings 104 and 106 and is attached to a nut 110 to hold the inserts 100 and 102 in place. The inserts 100 and 102 have tabs 56 and 58 on their upper ends identical to the tabs 56 and 58 of inserts 38 and 40 of FIG. 2.

With either the embodiment of FIG. 2B or that of FIGS. 8 and 9, there are significant advantages provided as compared to the prior art insert assembly of FIG. 2A.

The assemblies of the present invention have only two parts, namely the left and right-hand inserts with their integrally constructed locking members. The system of FIG. 2A, on the other hand, includes four parts, namely the two inserts and a nut and a bolt. The reduction in the number of parts provides savings both in the cost of the components, and in the costs of labor to assemble the inserts with the housing.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts may be made by those skilled in the art which changes are encompassed within the scope and spirit of the present invention as defined by the appended claims.

What is claimed is:

1. A cooling water pickup system, comprising:

a marine outdrive housing having a cooling water passage defined therein with first and second cooling water inlet openings defined through opposite sides of said housing and communicating said passage with an exterior surface of said housing, said exterior surface of said housing having first and second recesses defined therein by first and second recessed shoulders adjacent said first and second cooling water inlet openings, respectively;

a first cooling water pickup insert received in said first recess of said housing and abutting said first recessed shoulder, said first insert including a first locking member extending inward into said cooling water passage, said first locking member including a first camming surface and an outwardly facing first locking surface located outward of said first camming surface;

a second cooling water pickup insert received in said second recess of said housing and abutting said second recessed shoulder, said second insert including a second locking member extending inward into said cooling water passage, said second locking member including a second camming surface and an outwardly facing second locking surface located outward of said second camming surface; and wherein said first and second inserts and said housing are so arranged and constructed that when said first and second inserts are inserted into said first and second recesses of said housing and urged toward each other said first and second camming surfaces engage each other creating transversely directed camming forces, at least one of said locking members being sufficiently resilient to be deflected to allow said locking members to overlap until said first locking surface moves past said second locking surface to lock said inserts in place as said one resilient locking member returns toward an undeflected position.

2. The system of claim 1, wherein:

said first insert has a first retaining tab at one end thereof received behind a first wall of said housing to hold said one end in place within said first recess, said first locking member being located adjacent another end of said first insert; and said second insert has a second retaining tab at one end thereof received behind a second wall of said housing to hold said one end of said second insert in place within said second recess, said second locking member being located adjacent another end of said second insert.

3. The system of claim 1, wherein:

each of said first and second locking members includes one and only one camming surface and one and only one locking surface.

4. The system of claim 3, wherein:

said first and second locking members are substantially equally resilient in response to said camming forces.

5. The system of claim 1, wherein:

said first and second locking members are substantially equally resilient in response to said camming forces.

6. The system of claim 1, wherein:

each of said inserts, including its respective locking member, is integrally molded from a polymeric plastic material.

7. The system of claim 1, wherein:

said first locking member of said first insert includes a first plurality of sequentially located camming surfaces and a first plurality of outwardly facing locking surfaces alternately located between said camming surfaces of said first plurality of camming surfaces, said first camming surface and first locking surface being including in said first plurality of camming surfaces and said first plurality of locking surfaces, respectively, so that a discretely incrementally adjustable overlapping locking engagement between said first and second locking members is provided.

8. The system of claim 7, wherein:

said second locking member of said second insert includes a second plurality of sequentially located camming surfaces and a second plurality of outwardly facing locking surfaces alternately located between said camming surfaces of said second plurality of camming surfaces, said second camming surface and said second locking surface being included in said second plurality of camming surfaces and said second plurality of locking surfaces, respectively.

9. A cooling water pickup insert assembly for a marine outdrive, comprising:

a first cooling water pickup insert;

a second cooling water pickup insert; and locking means, defined on said first and second inserts, for locking said first and second inserts together to hold said inserts in place on said outdrive, when said inserts are pushed toward and engaged with each other through said locking means, with said outdrive sandwiched between said first and second inserts.

10. The assembly of claim 9, wherein:

said first insert has a first outdrive engagement means on one end thereof for holding said one end in place on said outdrive;

said second insert has a second outdrive engagement means on one end thereof for holding said one end of said second insert in place on said outdrive; and said locking means is further characterized as a means for locking other ends of said first and second inserts together when said other ends of said inserts are pushed toward each other.

11. The assembly of claim 9, wherein:

said locking means includes first and second locking elements attached to said first and second inserts, respectively, said first and second locking elements being slidably lockingly engaged with each other when said first and second inserts are pushed toward each other.

12. The assembly of claim 9, wherein:

said locking means includes first and second resiliently interlocking members defined on said first and second inserts, respectively.

13. The assembly of claim 9, wherein:

said locking means provides a means for varying a spacing between said first and second inserts in discrete increments.

14. A method of installing a cooling water pickup insert assembly on a marine outdrive, said method comprising the steps of:

providing an outdrive housing having first and second insert receiving recesses defined on opposite sides thereof adjacent first and second cooling water inlets, respectively;

providing first and second cooling water pickup inserts having complimentary first and second locking members defined thereon;

inserting said first and second inserts into said first and second recesses of said housing; and locking said inserts in place on said housing by pushing said first and second locking members together so that a protrusion of one of said locking members resiliently snaps into place in a complimentary cavity of the other of said locking members.

15. The method of claim 14, wherein:

said locking step is further characterized as locking said inserts snugly in place by pushing said first and second locking members together as far as possible so that said protrusion of said one of said locking members resiliently snaps into place into an outwardly furthest possible one of a plurality of sequentially placed complementary cavities in said other locking member.

* * * * *